US007745751B2

(12) United States Patent
Takahashi et al.

(10) Patent No.: US 7,745,751 B2
(45) Date of Patent: Jun. 29, 2010

(54) MEMBER FOR PUSH-BUTTON SWITCH AND METHOD OF MANUFACTURING THE SAME

(75) Inventors: Masahide Takahashi, Tokyo (JP); Tomohiko Kuwabara, Tokyo (JP); Tsutomu Nagasawa, Tokyo (JP); Toshihiko Egawa, Tokyo (JP)

(73) Assignee: Shin-Etsu Polymer Co., Ltd, Tokyo (JP)

( * ) Notice: Subject to any disclaimer, the term of this patent is extended or adjusted under 35 U.S.C. 154(b) by 299 days.

(21) Appl. No.: 11/912,782

(22) PCT Filed: Apr. 4, 2006

(86) PCT No.: PCT/JP2006/307637

§ 371 (c)(1),
(2), (4) Date: Oct. 26, 2007

(87) PCT Pub. No.: WO2006/120828

PCT Pub. Date: Nov. 16, 2006

(65) Prior Publication Data

US 2009/0057116 A1 Mar. 5, 2009

(30) Foreign Application Priority Data

May 2, 2005 (JP) ..... 2005-133802

(51) Int. Cl.
*H01H 3/12* (2006.01)

(52) U.S. Cl. ..... 200/341

(58) Field of Classification Search ..... 200/514, 200/512, 5 A, 341; 400/490
See application file for complete search history.

(56) References Cited

U.S. PATENT DOCUMENTS 5,589,121 A 12/1996 Inagaki et al.

(Continued)

FOREIGN PATENT DOCUMENTS

EP 1349186 A 1/2003

(Continued)

OTHER PUBLICATIONS

The above references (exept U.S. Patent 6,571,457, which corresponds to U.S. Publication 2001001786) were cited in a Dec. 19, 2008 Supplementary European Search Report of the counterpart European Patent Application No. 06 731 584.6-2214 (PCT/JP2006/307637).

*Primary Examiner*—Edwin A. Leon
(74) *Attorney, Agent, or Firm*—Mark Montague; Cowan, Liebowitz & Latman, P.C.

(57) ABSTRACT

A member for a push-button switch has key top members positioned close to each other through a distance of 1.5 mm or shorter at low cost and with high yield. The member has multiple key top members having resin key top cores and thermoplastic films covering the key top cores other than the lower surfaces thereof. The key top members are formed so that an interval between at least one set of adjacent key top members is 1.5 mm or shorter. In the key top members adjacent to each other through a distance of 1.5 mm or shorter, the maximum thickness of the thermoplastic films covering the key top cores is within the range of 75 to 350 μ, and the ratio of the minimum thickness of the thermoplastic films covering the key top cores to the maximum thickness is within the range of 0.4 to 0.9.

3 Claims, 9 Drawing Sheets

U.S. PATENT DOCUMENTS

| | | | | |
|---|---|---|---|---|
| 5,973,621 | A | 10/1999 | Levy | |
| 6,571,457 | B2 | 6/2003 | Naritomi | |
| 6,713,698 | B2 * | 3/2004 | Kashino | 200/341 |
| 2001/0011786 | A1 | 8/2001 | Naritomi | |
| 2002/0056613 | A1 * | 5/2002 | Tsuji | 200/5 A |
| 2003/0221944 | A1 * | 12/2003 | Arai et al. | 200/512 |

FOREIGN PATENT DOCUMENTS

| | | |
|---|---|---|
| JP | 07130246 | 5/1995 |
| JP | 10162689 | 6/1998 |
| JP | 11224561 | 8/1999 |
| JP | 2003297180 | 10/2003 |
| JP | 2004063449 | 2/2004 |
| JP | 2004213924 | 7/2004 |
| JP | 2004253290 | 9/2004 |

* cited by examiner

MEMBER FOR PUSH-BUTTON SWITCH AND METHOD OF MANUFACTURING THE SAME

TECHNICAL FIELD

The present invention relates to a member for push-button switch used for, for example, a mobile communication equipment, a digital camera, an electronic notebook, an in-car panel switch, a remote control unit, and a keyboard, and also relates to the method of manufacturing the same.

BACKGROUND OF THE INVENTION

In recent years, key top members arranged in close contact with each other at intervals of 1.5 mm or less have been demanded from the viewpoints of miniaturization, weight reduction, and good design of mobile communication equipments such as a cellular phone and an automobile phone, a digital camera, a home telephone, a facsimile, an electronic notebook, a measurement equipment, an in-car panel switches, a remote control units, a controller, a keyboard, and the like. Generally, the thermoplastic film used for key top members is made of a highly heat-resistant resin such as a bi-axially oriented polyethylene terephthalate resin or polycarbonate resin. For this reason, the thermoplastic film is hard to be stretched to a size enough to cover the closely arranged state of the completed product. Accordingly, under a current method, a plurality of key top members each comprised a thermoplastic film and a key top core are prepared one by one, the plurality of key top members are assembled into the form of a completed product, thereby manufacturing a member for push-button switch comprised closely arranged key top members (for example, see Patent Document 1).

Patent Document 1: Japanese Patent Application Laid-Open No. 2004-253290 (Claims, Abstract, and others)

SUMMARY OF THE INVENTION

However, under the above-described prior art, a plurality of key top members must be prepared one by one, and requires a plurality of molds and jigs. This results in the increase in the initial and material costs, and the prolongation of the lead time. In addition, the assembling process is complicated and the yield deteriorates.

The present invention has been accomplished in view of the above-described problems, and is intended to provide a low-cost and high-yield member for push-button switch comprised key top members arranged in close contact with each other at intervals of 1.5 mm or less, and a method of manufacturing the same.

In order to accomplish the above object, the inventors have established a method which does not require the preparation of a plurality of key top members one by one, wherein a thermoplastic film for covering key top cores is integrally formed according to the shape of the completed product in which the key top members are arranged in close contact with each other, and then the integrally formed thermoplastic film is integrated with the key top cores. As a result of various studies, regarding the closely arranged key top members, the inventors have found a suitable stretching ratio of the thermoplastic film covering the top and sides of the key top cores, and have accomplished the present invention as described below.

More specifically, an aspect of the present invention is a member for push-button switch comprised a plurality of key top members each having a resin key top core and a thermoplastic film covering the key top core except for the bottom thereof, wherein among the key top members, at least one pair of adjacent key top members are arranged at a distance of 1.5 mm or less, the thermoplastic film covering the key top cores in the adjacent key top members arranged at a distance of 1.5 mm or less has a maximum thickness (t0) in the range from 75 to 350 μm, and the ratio (t1/t0) between the maximum thickness (t0) and the minimum thickness (t1) of the thermoplastic film covering the key top cores is in the range from 0.4 to 0.9.

Accordingly, there is provided a member for push-button switch comprised an integral key top member body having resin key top cores covered by a thermoplastic film, wherein at least one pair of adjacent key top members are closely arranged at a distance of 1.5 mm or less. Therefore, a member for push-button switch is completed by separating the key top members into individual units in the assembling process. As a result, a member for push-button switch is prepared at a low cost and in a high yield. Preferable examples of the thermoplastic film include resins such as an acrylic resin, a polycarbonate resin, or a noncrystalline polyethylene terephthalate resin. In particular, the thermoplastic film is more preferably an acrylic resin. Examples of the acrylic resin include an acrylate resin and any polymer alloys including the acrylate resin.

The reason that the ratio (t1/t0) between the maximum thickness (t0) and the minimum thickness (t1) of the thermoplastic film covering the key top cores is limited to the range from 0.4 to 0.9 is as follows: if the ratio t1/t0 is more than 0.9, the stretching ratio of the thermoplastic film is so low that the formation of the projections and depressions of the key top members becomes difficult, and if the ratio t1/t0 is less than 0.4, the stretching ratio of the thermoplastic film is so high that the film is probably whitened by stress or ruptured, which results in the failure in forming. If the thickness of the thermoplastic film is less than 75 μm, the film becomes so soft that the mechanical strength, surface hardness, and thermal properties of the film will deteriorate. On the other hand, if the thickness of the thermoplastic film is more than 350 μm, forming according to the projections and depressions of the key top members becomes difficult. Accordingly, the thickness of the thermoplastic film is preferably in the range from 75 to 350 μm.

Another aspect of the present invention is the member for push-button switch according to the present invention wherein the key top cores are made of a photocuring resin.

In case where a resin for forming the key top cores is injected into and cured in the concave portions of the preformed thermoplastic film, the material of the key top cores is preferably a photocuring resin. Photocuring resins are broadly divided into EB curing resins, UV curing resins, and anaerobic composite UV curing resins. EB curing resins cure by the irradiation of electron beams. UV curing resins cure by the irradiation of ultraviolet light. Anaerobic composite UV curing resins have UV curability and anaerobic properties, and cure by the irradiation of UV under anaerobic conditions. Of these resins, UV curing resins are most preferable because they require low equipment costs, quickly cures, and provide advantageous productivity. These photocuring resins are composed mainly of a photocurable resin and a photo-polymerization initiator. Examples of the photocurable resin include urethane-based, epoxy-based, polyester-based, silicone-based, and polybutadiene-based acrylic resins. Examples of the photo-polymerization initiator include benzophenone-based photopolymerization initiators, acetophenone-based photopolymerization initiators, and thioxanthone-based photopolymerization initiators or the like. In the case of the anaerobic composite UV curing resins, organic peroxides, aromatic sulfimides, and various amines are added. Examples of the organic peroxide include ketone peroxides, dialkyl peroxides, diacyl peroxides, and peroxyesters.

Another aspect of the present invention is the member for push-button switch according to the present invention, wherein an electroluminescence (EL) phosphor is placed on the key top cores on the side not covered by the thermoplastic film. Unlike a light emitting diode (LED), an EL phosphor can have a thin sheet shape, so that it can be readily placed just below the key top cores. In addition, in order to absorb projections and depressions formed by shrinkage of a photocuring resin, the EL phosphor may be placed with the intervention of a resin film, not just below the key tops. In this case, the key tops may be attached to the EL phosphor after being separated into individual units, which prevents damages to the EL phosphor. By placing the EL phosphor below the key top cores, specific portions of the key tops (for example, the top of the key tops) are brightened. In particular, a member for push-button switch with excellent functionality and design is provided by selectively brightening a picture provided on the top of the key tops.

Another aspect of the present invention is a method of manufacturing a member for push-button switch comprised a plurality of key top members each having a resin key top core and a thermoplastic film covering the key top core except for the bottom thereof, wherein among the key top members, at least one pair of the adjacent key top members are arranged at a distance of 1.5 mm or less, the thermoplastic film covering the key top cores in the adjacent key top members arranged at a distance of 1.5 mm or less has a maximum thickness (t0) of from 75 to 350 μm, and the method of manufacturing a member for push-button switch includes: a forming step of stretching the thermoplastic film heated at a temperature from 135 to 145° C. according to the shape of the mold thereby forming the thermoplastic film to a size enough to cover a plurality of adjacent key top cores; an integration step of integrating the plurality of adjacent key top cores with the formed thermoplastic film thereby making a key top member body; an arrangement step of placing the key top member body on a base member for pressing the switch; and a separation step of separating the key top member body into individual units of the key top members.

Such a method provides a member for push-button switch comprised an integral key top member body having resin key top cores covered by a thermoplastic film, wherein at least one pair of the adjacent key top members are closely arranged at a distance of 1.5 mm or less. Accordingly, a member for push-button switch is made without the necessity of making key top members one by one in an assembly step. As a result, a member for push-button switch is manufactured at a low cost and in a high yield. In particular, no necessity of attaching individual key top members to a base member one by one exists by carrying out the separation step of separating the key top member body into individual units of the key top members after the arrangement step of placing the key top member body comprised a plurality of connecting key top members on the base member. Examples of the forming method used in the forming step include: pressure forming wherein a high pressure gas is blown from the side opposite to the mold of the thermoplastic film thereby forming the thermoplastic film according to the shape of the mold; vacuum pressure forming wherein the thermoplastic film is depressurized from the side of the mold concurrently with the pressure forming thereby forming the thermoplastic film according to the shape of the mold; and vacuum forming wherein the thermoplastic film is depressurized from the side of the mold thereby forming the thermoplastic film according to the shape of the mold.

The preferable examples of the thermoplastic film covering the key top cores include resins such as an acrylic resin, a polycarbonate resin, and a noncrystalline polyethylene terephthalate resin or the like. In particular, an acrylic resin is more preferable as the thermoplastic film. Examples of the acrylic resin include an acrylate resin and any polymer alloys including the acrylate resin. The thermoplastic film has a thickness so as to achieve a maximum thickness (t0) in the range from 75 to 350 μm after being stretched for forming. If the thickness is less than the range, the formed film tends to be whitened by stress or ruptured, and if the thickness is more than the range, the film is hard to be stretched. The heating temperature for the thermoplastic film during forming is in the range from 135 to 145° C. Specifically, the mold is heated within the temperature range to form the thermoplastic film. In case where the height of the key tops is higher, and the distance between the adjacent key tops is smaller, the degree of difficulty in forming the thermoplastic film covering them becomes higher. With the increase in the degree of difficulty in forming, the heating temperature for the thermoplastic film must be increased. However, in case where a thermoplastic film having a picture thereon is formed according to the shape of the mold, the position control of the picture becomes difficult if the thermoplastic film in contact with the mold is heated at a temperature of 160° C. or higher. Accordingly, the thermoplastic film is preferably heated at a temperature lower than 160° C.

Another aspect of the present invention is the method of manufacturing a member for push-button switch according to the present invention, wherein in the forming step, a plug is pressed onto the thermoplastic film in the regions to be the concave portions of adjacent key top members thereby forming the thermoplastic film.

Pressing a plug onto the concave portions improves the accuracy of forming in comparison with the cases where vacuum, pressure, or vacuum pressure forming is carried out alone. In particular, the effect of pressing the plug is higher when the thermoplastic film has a high stretching ratio during forming (the ratio (t1/t0) between the maximum thickness (t0) and the minimum thickness (t1) of the thermoplastic film covering the key top cores is from 0.4 to 0.7). On the other hand, in case where the thermoplastic film has a low stretching ratio during forming is low (t1/t0 is more than 0.7 and 0.9 or less), a desired shape is relatively readily formed even without using a plug.

Another aspect of the present invention is the method of a member for push-button switch according to the invention, wherein the plug heated in the temperature range from the softening temperature of the thermoplastic film to 180° C. is pressed into the concave portions.

The plug is preferably changed according to the type of the thermoplastic film, and is preferably heated in the temperature range from the softening temperature of the thermoplastic film to 180° C. If the temperature of the plug is lower than the softening temperature of the film, the portions of the thermoplastic film pressed by the plug may be cooled to be ruptured. On the other hand, if the temperature of the plug is higher than 180° C., the pressed portions may be perforated. Accordingly, the temperature of the plug is preferably in the range from the softening temperature of the thermoplastic film to 180° C. For example, in case where the thermoplastic film is heated at a temperature of 140° C. during forming, the plug to be used as the pressing member is preferably heated in the temperature range from 90 to 180° C., preferably at 140° C., which is the same heating temperature as that for the thermoplastic film.

Another aspect of the present invention is the method of a member for push-button switch according to the invention, wherein in the forming step, pressure forming or vacuum pressure forming is carried out.

By the use of the pressure forming or vacuum pressure forming, an appropriate response can be made in case where the thermoplastic film must be formed with a high stretching ratio. In the process of pressure forming or vacuum pressure forming, it is preferable that a gas (for example, air) is blown on the thermoplastic film at a pressure over 5 kgf/cm$^2$. In case where the stretching ratio may be low, vacuum forming may be used in place of the pressure forming or vacuum pressure forming.

Another aspect of the present invention is the method of manufacturing a member for push-button switch according to the invention, wherein in the integration step, the formed thermoplastic film is placed in a mold, the photocuring resin for forming the key top cores is placed in the concave portions on the thermoplastic film placed in the mold, and the photocuring resin is cured by the irradiation of light or electron beams. Therefore, key top cores covered by a thermoplastic film are manufactured with no damage to the formed thermoplastic film.

Another aspect of the present invention is the method of manufacturing a member for push-button switch according to the invention, wherein in the integration step, another thermoplastic film is inserted between the formed thermoplastic film and the key top cores. In case where a picture is formed on the thermoplastic film, the picture may be broken when the film is brought into contact with a resin for forming the key top cores. If there is such a risk, it is preferable that another thermoplastic film is placed on the thermoplastic film, and then the resin for forming the key top cores is provided on the another thermoplastic film. In this case, two or more sheets of the thermoplastic film are laminated. The ratio t1/t0 is determined on the assumption that the two or more sheets of the thermoplastic film are one sheet of the thermoplastic film.

Another aspect of the present invention is the method of manufacturing a member for push-button switch according to the invention, wherein in the arrangement step, an electroluminescence phosphor is placed between the key top cores and the base member. By placing an EL phosphor just below the key top cores, a specific portion of the key tops (for example, the top of the key tops) can be brightened. In particular, a member for push-button switch with excellent functionality and design is provided by selectively brightening a picture provided on the top of the key top member.

ADVANTAGEOUS EFFECT OF THE INVENTION

According to the present invention, there is provided a low-cost and easy-to-assemble member for push-button switch comprised key top members closely arranged at a distance of 1.5 mm or less.

Figure 1:
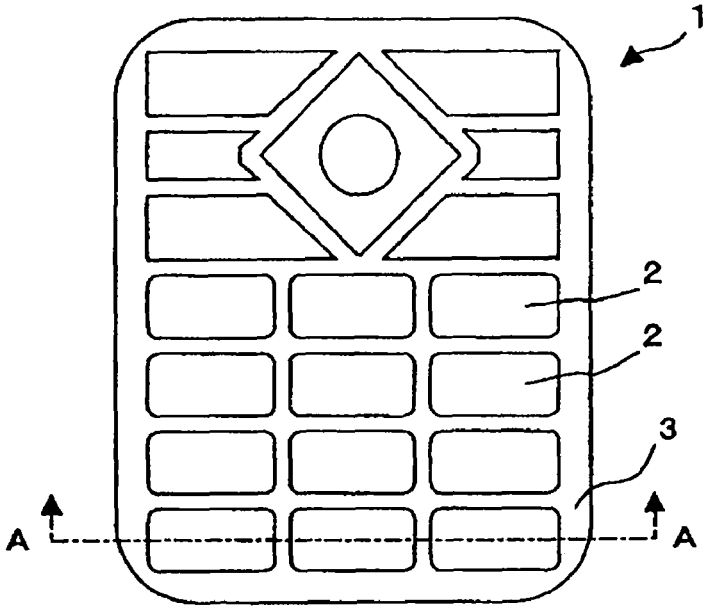
FIG. 1 is a plan view of the member for push-button switch according to a first embodiment of the present invention.

1: member for push-button switch
2: key top member
3: base member
4: resin film
21: key top core
22: thermoplastic film
22*a*: flange
23: key top member body
31: projection
32: boss
40: mold
41: plug
42: projection
51: mold
70: EL phosphor

DETAILED DESCRIPTION

The embodiments of the member for push-button switch and the method of manufacturing the same according to the present invention are further described below in details. In the following embodiments and examples, an acrylate resin is used as the thermoplastic film, and the film may be other resin such as an acrylic resin other than the acrylate resin, a polycarbonate resin, or a noncrystalline polyethylene terephthalate resin.

First Embodiment

Figure 2:
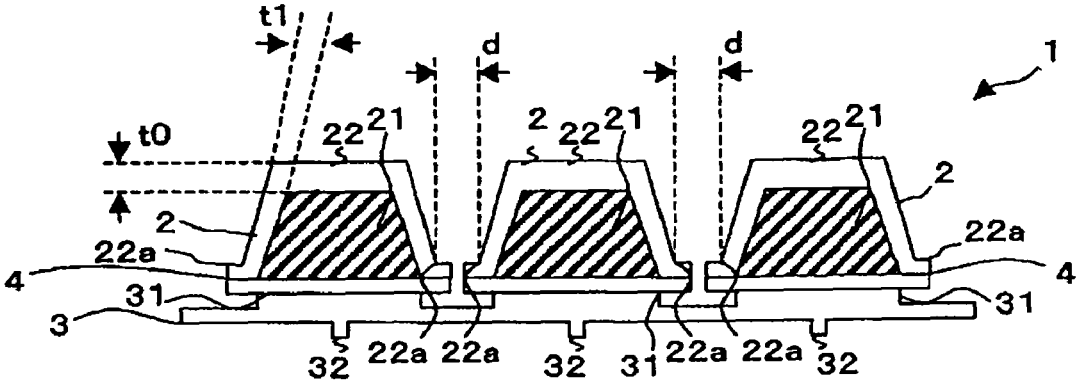
FIG. 2 is a cross sectional view of the member for push-button switch shown in FIG. 1 along the line A-A.

FIG. 1 is a plan view of a member for push-button switch 1. FIG. 2 is a cross sectional view of the member for push-button switch 1 shown in FIG. 1 along the line A-A (resin key top cores 21 are selectively denoted by hatched lines).

As shown in FIGS. 1 and 2, the member for push-button switch 1 mainly comprises a plurality of key top members 2, and a base member 3 in contact with the bottom of the key top member 2. The base member 3 is a member which is pressed by the key top members 2 so as to push the switch placed on the lower portion. The plurality of key top members 2 are attached to the base member 3 with the intervention of a resin film 4. The space between the key top members 2 and the resin film 4, or between the resin film 4 and the base member 3 is fixed with an adhesive, tacky agent or the like. In case where a picture is to be formed under the key top members 2, the picture may be formed on the resin film 4 in advance. In case where a picture is formed on the underside of the resin film 4, transparency enough to permit visual recognition of the picture is required of the thermoplastic film 22 and as necessary other thermoplastic film, key top cores 21, adhesive, and resin film 4. In case where a picture is formed on the top of the resin film 4, transparency enough to permit visual recognition of the picture is required of the thermoplastic film 22 and as necessary other thermoplastic film, key top cores 21, and adhesive. In case where a picture is formed on the thermoplastic film 22 exclusively on the side of the key top cores 21, transparency enough to permit visual recognition of the picture is required of the thermoplastic film 22. In case where a picture is formed on the thermoplastic film 22 exclusively on the top side, no transparency is required of any members. More specifically, transparency is required of members placed higher than the portion having a picture. The resin film 4 is not an essential component member. The key top members 2 may be directly attached to the base member 3.

The key top members 2 mainly comprise the key top cores 21 made of resin, and the thermoplastic film 22 covering the key top cores 21 except for the bottom thereof. The thermoplastic film 22 is integrally formed according to the final arrangement of the key top members 2 before being integrated with the key top cores 21. The member for push-button switch 1 includes some key top members 2 separated at a distance d of 1.5 mm or less. After the key top members 2 are formed, in the late stage of the manufacturing process of the member for push-button switch 1, the thermoplastic film 22 is cut into pieces. In almost cases, the cutting operation produces flanges 22*a* around the key top members 2.

The distance d refers to the shortest distance among the distances between the adjacent two key top members 2 at any position from the top to the base of the flange 22*a*. Accordingly, as shown in FIG. 2, in case where the key top members 2 have a tapered shape expanding from the top to the flanges 22*a*, the member for push-button switch 1 may be included in the present invention as long as the distance between the bases of the flanges 22*a* of the key top members 2 is 1.5 mm or less, even though the distance between the tops is more than 1.5 mm.

As described below, the thermoplastic film 22 is preformed before being integrated with the key top cores 21. In this step, the thermoplastic film 22 is integrally formed in such a way that the ratio (t1/t0) between the maximum thickness (t0) on the top of the key top members 2 and the minimum thickness (t1) on the sides is from 0.4 to 0.9. The reason that the ratio (t1/t0) is limited to the range from 0.4 to 0.9 is as follows: if the ratio t1/t0 is more than 0.9, the stretching ratio of the thermoplastic film 22 is so low that the formation of the projections and depressions of the key top members 2 becomes difficult, and if the ratio t1/t0 is less than 0.4, the stretching ratio of the thermoplastic film 22 is so high that the film 22 is easy to be whitened by stress or ruptured, which results in the failure in forming. When the ratio t1/t0 is from 0.4 to 0.9, the thermoplastic film 22 is integrally formed without hindering the formation of the projections and depressions of the key top members 2, even though at least one adjacent pair of the key top members 2 are closely arranged at a distance d of 1.5 mm or less.

The base member 3 comprises projections 31 for mounting the key top members 2, and bosses 32 on the side opposite to the projections 31. The bosses 32 turn on or turn off the switch below (not shown) in response to the press of the key top members 2.

Figure 3:
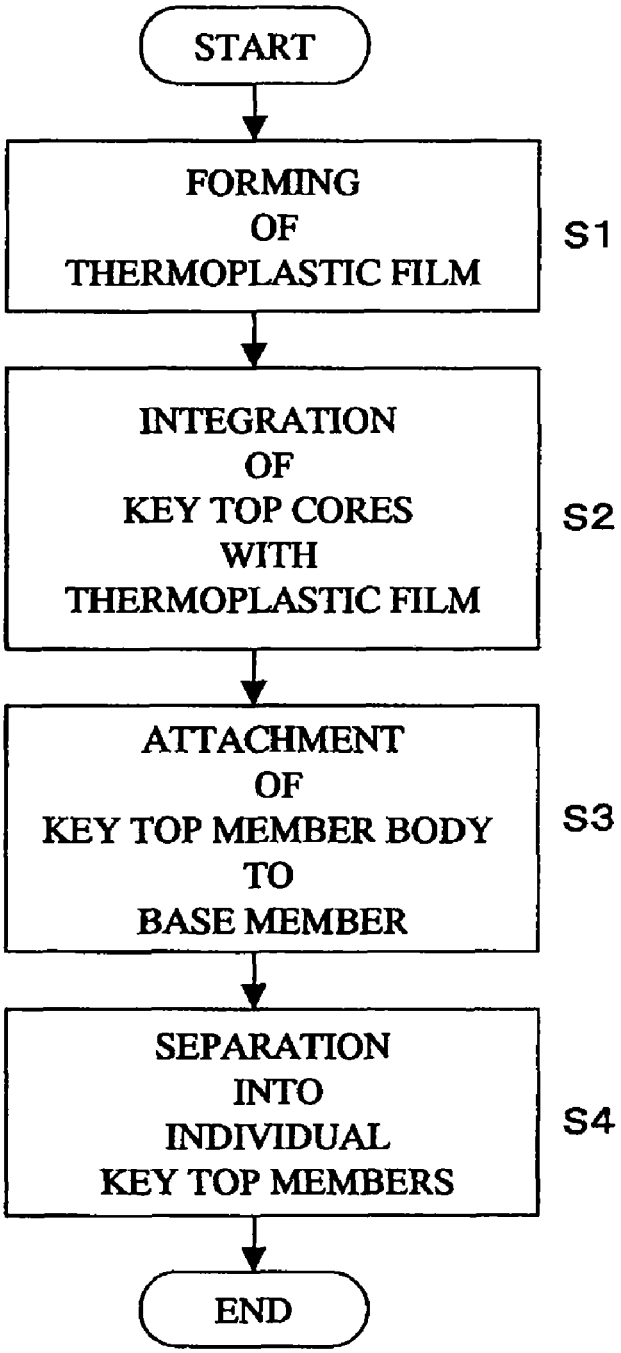
FIG. 3 is a flowchart showing the main steps of the manufacturing process of the member for push-button switch shown in FIG. 1.

FIG. 3 is a flowchart showing the main steps of the manufacturing process of the member for push-button switch 1. FIGS. 4 to 9 are diagrams for illustrating the individual steps.

Figure 6:
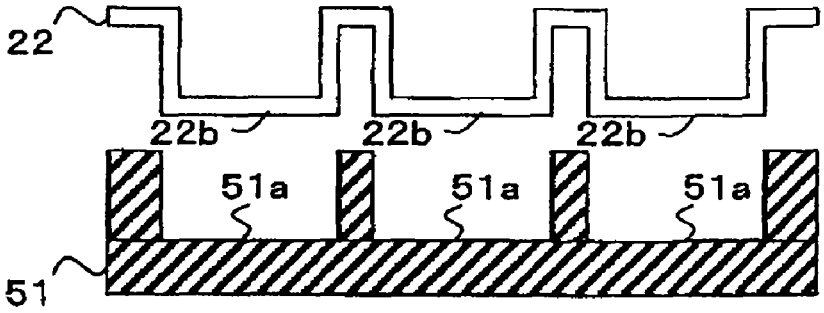
FIG. 6 is a diagram for illustrating the step S2 shown in FIG. 3, showing the state of placing an integrally formed thermoplastic film in a mold.
Figure 7:
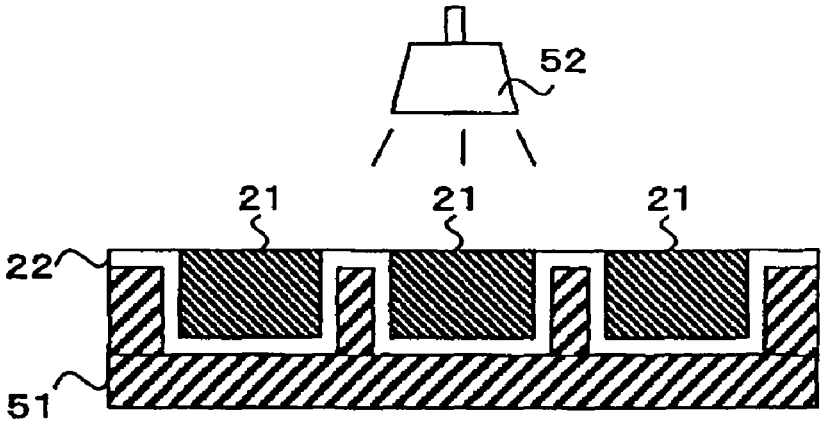
FIG. 7 is a diagram for illustrating the step S2 shown in FIG. 3, showing the state following the state shown in FIG. 5, wherein an UV curing resin is injected onto the thermoplastic film placed in the mold, and ultraviolet light is radiated thereby integrating the thermoplastic film with the key top cores.
Figure 8:
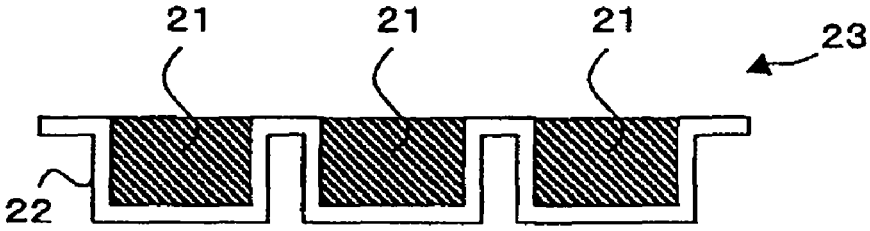
FIG. 8 is a diagram for illustrating the step S2 shown in FIG. 3, showing the state following the state shown in FIG. 7, wherein the mold is removed to obtain a key top member body comprised the thermoplastic film integrated with the key top cores.
Figure 9:
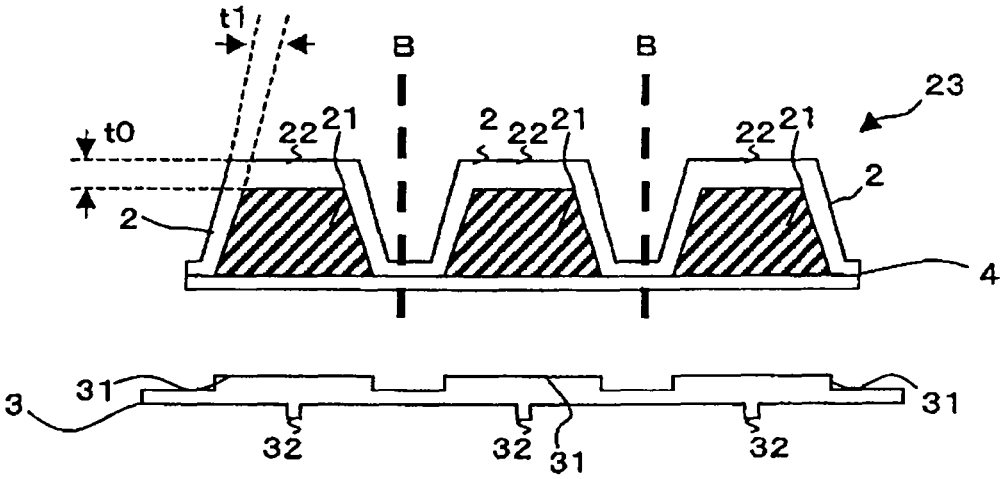
FIG. 9 is a diagram for illustrating the steps S3 and S4 shown in FIG. 3, showing the state wherein the key top member body is attached to the base member, and then the key top member body is separated into individual units of the key top members.

The manufacturing process of the member for push-button switch 1 includes a step of integrally forming the thermoplastic film 22 (step S1), a step of integrating the key top cores 21 with the thermoplastic film 22 (step S2), a step of attaching the key top member body 23 integrated with the key top members 2 to the base member 3 (step S3), and a step of separating the key top members 2 from the key top member body 23 (step S4). FIGS. 4A, 4B, 5A and 5B illustrate the step S1. FIGS. 6 to 8 illustrate the step S2. FIG. 9 illustrates the steps S3 and S4. The manufacturing process of the member for push-button switch 1 is further described below in details with reference to FIGS. 4A, 4B, 5A, 5B, 6 to 9. The order of the steps S3 and S4 may be reversed, wherein the key top member body 23 may be separated into individual units of the key top members 2, and then attached to the base member 3.

In the step S1, the thermoplastic film 22 is formed using the mold 40. In order to integrally form the thermoplastic film 22 according to the final arrangement of the key top members 2, the mold 40 having projections and depressions according to the shape of the key top members 2 is used. The forming method may be any of pressure forming, vacuum forming, or pressure vacuum forming method. Pressure forming is a forming process wherein the thermoplastic film 22 is once softened by heating, and brought into intimate contact with the mold 40 to be stretched to form the predetermined shape using compressed air. Vacuum forming is a process wherein the thermoplastic film 22 is once softened by heating, and brought into intimate contact with the mold 40 to be stretched to form the predetermined shape using the pressure difference owing to vacuum aspiration from the side of the mold 40. Pressure vacuum forming is a process wherein the vacuum forming and pressure forming processes are combined thereby stretching the thermoplastic film 22 along the mold 40.

Figure 4A:
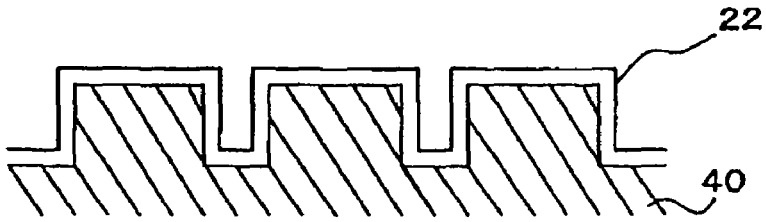
FIG. 4A is a diagram for illustrating the step S1 shown in FIG. 3, and represents a forming method for a thermoplastic film with low stretchability.
Figure 4B:
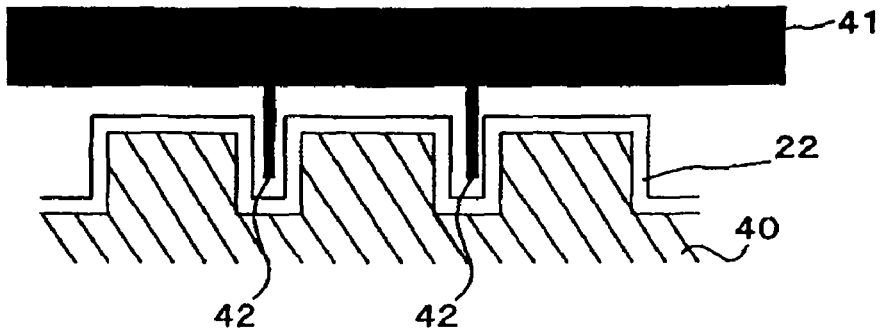
FIG. 4B is a diagram for illustrating the step S1 shown in FIG. 3, and represents a forming method for a thermoplastic film with high stretchability.

In case where the stretching ratio of the thermoplastic film 22 during forming is low (specifically, t1/t0 is more than 0.7 and 0.9 or less), as shown in FIG. 4A, the thermoplastic film 22 may be formed by any of the above-described forming methods using the mold 40 alone. On the other hand, in case where the stretching ratio of the thermoplastic film 22 during forming is relatively high (specifically, t1/t0 is more than 0.4 to 0.7), as shown in FIG. 4B, it is preferable that forming by any of the above-described forming methods is assisted by pressing of the projections 42, which are provided on the plug 41 on the side opposing to the mold 40, into the concave portions of the thermoplastic film 22 stretched along the mold 40. The plug 41 may be used when the stretching ratio of the thermoplastic film 22 during forming is relatively low (specifically, t1/t0 is more than 0.7 and 0.9 or less).

In case where the thermoplastic film 22 is formed with the assistance of the plug 41, the plug 41 has preferably been heated in the temperature range from the softening temperature of the thermoplastic film 22 to 180° C. When the temperature of the plug 41 is the softening temperature of the thermoplastic film 22 or more, the plug 41 will not cool down the portions of the thermoplastic film 22 through the contact between them, which reduces the risk of rupture of the thermoplastic film 22 from the portions in contact with the plug 41. On the other hand, when the temperature of the plug 41 is 180° C. or lower, the risk of perforation of the film due to excessive expansion of the portions in contact with the plug 41 is reduced. For example, in case where the thermoplastic film 22 is formed under heating at a temperature of 140° C., the plug 41 have preferably been heated in the temperature range from 90 to 180° C., preferably heated at 140° C. which is the same heating temperature as that for the thermoplastic film 22.

In case where the plug 41 is used, the control of positional relationship between the mold 40 and the plug 41 is important. If the positional relationship between the plug 41 and the mold 40 is not accurately controlled, the plug 41 may press portions deviated from the concave portions on the thermoplastic film 22, which may result in perforation of the thermoplastic film 22. The cooling rate of the thermoplastic film 22 is preferably 12° C./sec or more from the viewpoint of dimensional stability of the formed thermoplastic film 22.

Figure 5A:
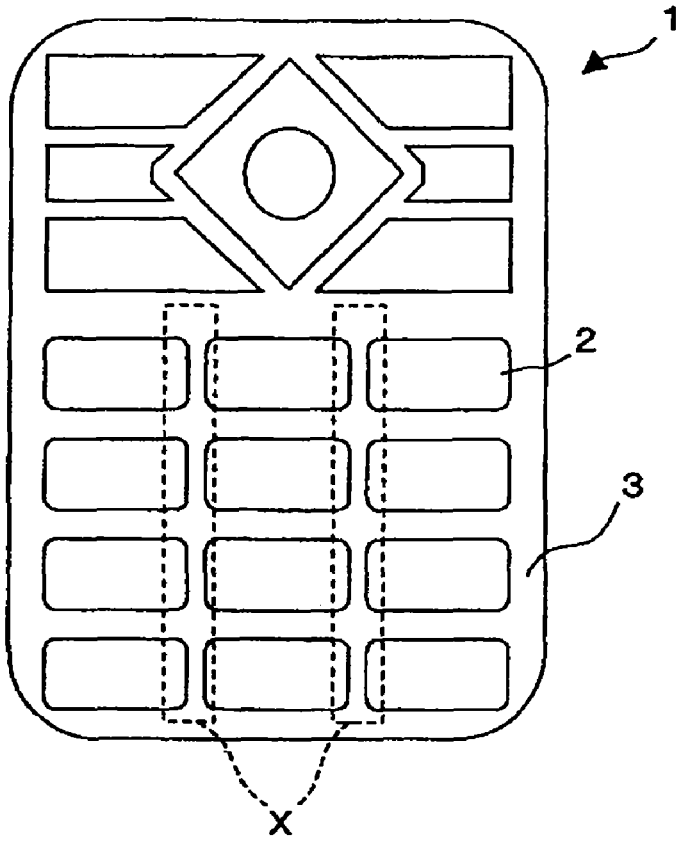
FIG. 5 are diagrams for illustrating the conditions for integrally forming a thermoplastic film for manufacturing a member for push-button switch comprised a plurality of key top members having different heights.
Figure 5B:
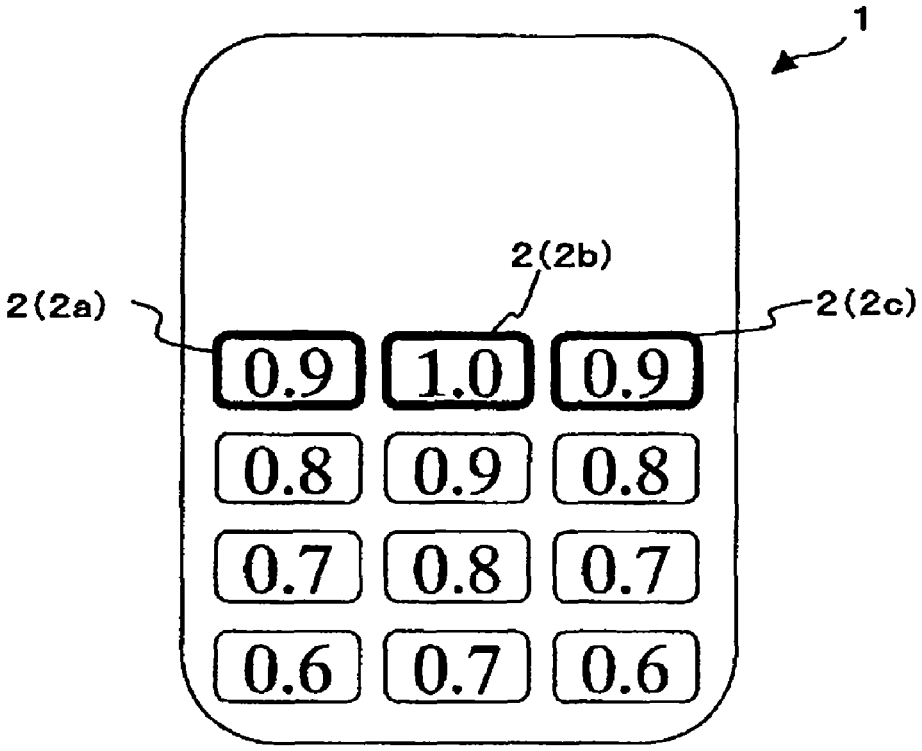

FIGS. 5A and 5B are diagrams for illustrating the conditions for integrally forming the thermoplastic film 22 for manufacturing the member for push-button switch 1 comprised the plurality of key top members 2 having different heights.

As shown in FIG. 5A, the distance between 12 pieces of the key top members 2 placed below the member for push-button switch 1 according to the present embodiment is not equal. The smallest distance is between the three pieces of horizontally arranged key top members 2 (distances in the regions enclosed by dotted lines denoted by X in FIG. 5A). FIG. 5B shows the heights of the key top members 2 arranged with the smallest distance in the unit of mm. The key top member 2(2*b*) is the highest one among the key top members 2, and denoted by "1.0". The key top members 2(2*a*) and 2(2*c*) arranged at the right and left of the key top member 2(2*b*) in FIG. 5B are adjacent to the key top member 2(2*b*) at the smallest distance. Therefore, the region of the key top members 2(2*a*) and 2(2*b*), or the key top members 2(2*b*) and 2(*c*) is where forming is the most difficult. More specifically, such a region is where the stretching ratio of the thermoplastic film 22 is highest. Accordingly, when the thermoplastic film 22 is integrally formed, the forming conditions need to be selected according to such regions. This is because forming gets complicated as the height of the key top members 2 increases, and the distance d between the adjacent key top members 2 decreases. In case where the adjacent key top members 2 have different heights, the difficulty of forming may be evaluated on the basis of the value determined by dividing the average height of the adjacent key top members 2 by the distance d of the key top members 2.

After the integral forming of the thermoplastic film 22 in the step S1, the flow proceeds to the step S2. In the step S2, the key top cores 21 are integrated with the thermoplastic film 22. In the present embodiment, the step S2 is carried out through the injection and curing of a UV curing resin.

As shown in FIG. 6, the thermoplastic film 22 is mounted on a mold 51 having concave portions 51*a* conforming to the projections 22*b* of the thermoplastic film 22. Subsequently, as shown in FIG. 7, a UV curing resin is injected into the concave portions formed on the thermoplastic film 22 (at the backside of the projections 22*b*), and the UV curing resin is irradiated with ultraviolet light using a black light 52. As a result, the key cores 21 are formed. The UV curing resin may be replaced with an EB curing resin or an anaerobic composite UV curing resin.

In place of the photocuring resin, a molten thermoplastic resin may be injected into the concave portions formed at the backside of the projection 22*b* on the thermoplastic film 22, wherein the injected thermoplastic resin is cured by cooling. However, since the thermoplastic film 22 after stretching is very thin and readily ruptured, the injection and curing of a photocuring resin is preferable rather than such an injection molding from the viewpoint of a small pressure load.

After the curing of the key top cores 21, as shown in FIG. 8, the key top member body 23 comprised the thermoplastic film 22 integrated with the key top cores 21 is removed from the mold 40. In this state, the key top members 2 are connected with each other.

In the step of integrating the thermoplastic film 22 with the key top cores 21, the picture formed on the thermoplastic film 22 in advance may be broken. If there is such a possibility, it is preferable that the resin for the key top cores 21 is injected from another thermoplastic film arranged on the thermoplastic film 22. In such a case, the ratio t1/t0 is determined by counting as "one" the thermoplastic film 22 integrated with the thermoplastic film.

After the integration of the thermoplastic film 22 with the key top cores 21 by the step S2, the flow progresses to the steps S3 and S4. As shown in FIG. 9, the key top member body 23 is attached to the projections 31 of the base member 3 with the intervention of the resin film 4. Subsequently, as denoted by dotted lines B in FIG. 9, the key top member body 23 is separated into individual units of the key top members 2. Examples of the method for separation include those using a cutting blade, Leutor (NC processing machine), an ultrasonic cutter, or laser beams. In order to improve the operability and appearance of the keys, the keys are preferably separated with a gap secured between them. From this viewpoint, separation using laser beams is more preferable. In addition, the use of laser beams increases the machining speed.

Second Embodiment

The second embodiments of the member for push-button switch and the method of manufacturing the same according to the present invention are described below with reference to the following drawings. The same components as the first embodiment are denoted by the same reference numerals.

FIGS. 10A, 10B and 11A to 11C are diagrams for showing the sectional structures of conventional members for push-button switch wherein the key top members 2 are brightened using a LED 60, and the sectional structures of the second embodiment of the member for push-button switch 1, respectively.

Figure 10A:
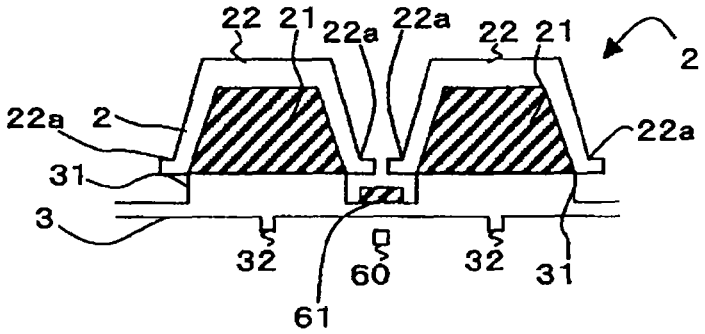
FIGS. 10A and 10B are diagrams showing sectional structures of conventional members for push-button switch, wherein the key top members are brightened using LED.

As shown in FIG. 10A, under a conventional method, in case where the key top members 2 are brightened using the LED 60, the LED 60 is arranged on the backside of the base member 3 in a position between the adjacent key top members 2. The reason is that a space enough to accommodate the LED 60 is provided only between the bosses 32, because a switch is placed just below the bosses 32. Therefore, for example, a light shielding member 61 is placed between the flanges 22*a* of the adjacent key top members 2 thereby preventing light leakage from the gap between the adjacent key top members 2.

Figure 10B:
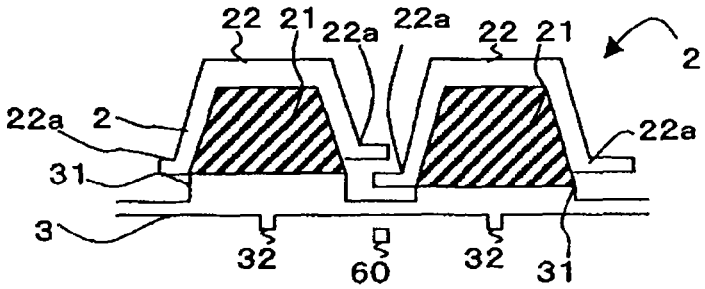

As shown in FIG. 10B, in place of providing the light shielding member 61, the flanges 22*a* of the adjacent key top members 2 may be overlapped with a level difference in the horizontal direction thereby preventing light leakage from the LED 60 through the gap between the adjacent key top members 2.

However, in the structures shown in FIGS. 10A and 10B, the LED 60 is not placed just below the key top members 2, so that low brightness is provided, and uniform illumination is difficult. Even if the light shielding member 61 is provided or the adjacent flanges 22*a* are overlapped, light tends to be leaked from the adjacent key top members 2.

Figure 11A:
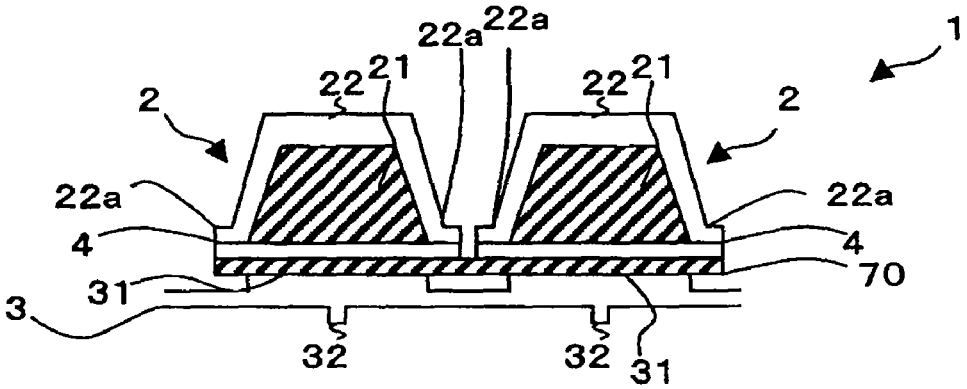
FIGS. 11A to 11C are diagrams showing sectional structures of the member for push-button switch according to a second embodiment.
Figure 11B:
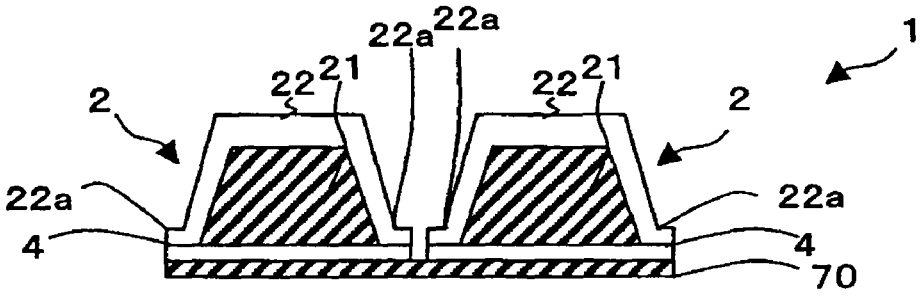
Figure 11C:
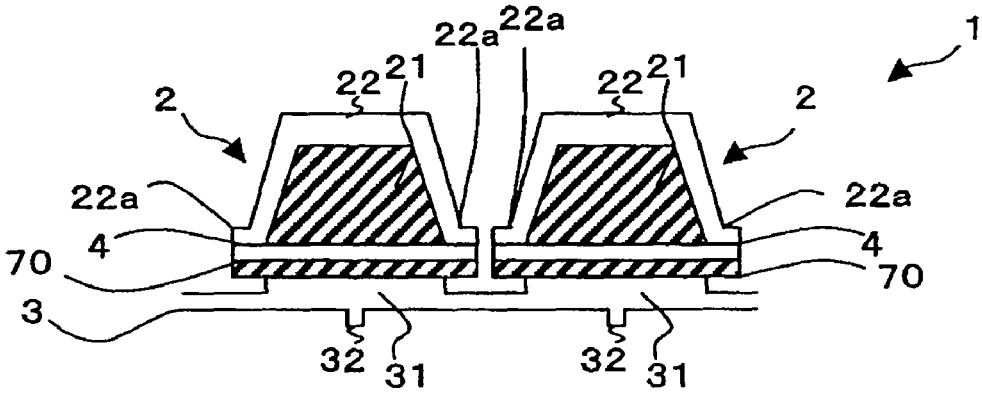

In the second embodiment of the member for push-button switch 1 according to the present invention, as shown in FIGS. 11A to 11C, an EL phosphor 70 is placed just below the key top members 2. The member for push-button switch 1 shown in FIGS. 11A and 11B comprises an EL phosphor 70 placed over the plurality of key top members 2, and the member for push-button switch 1 shown in FIG. 11C comprises EL phosphors 70 placed below each of the key top members 2. Thus, the EL phosphor(s) 70 placed just below the key top members 2 brightens the key top members 2 more uniformly than illumination of the key top members 2 from the side. In addition, there is no necessity of using an additional member such as the light shielding member 61. The resin film 4 is not an essential component member. The key top members 2 may be arranged on the EL phosphor 70 placed on the base member 3.

Figure 12:
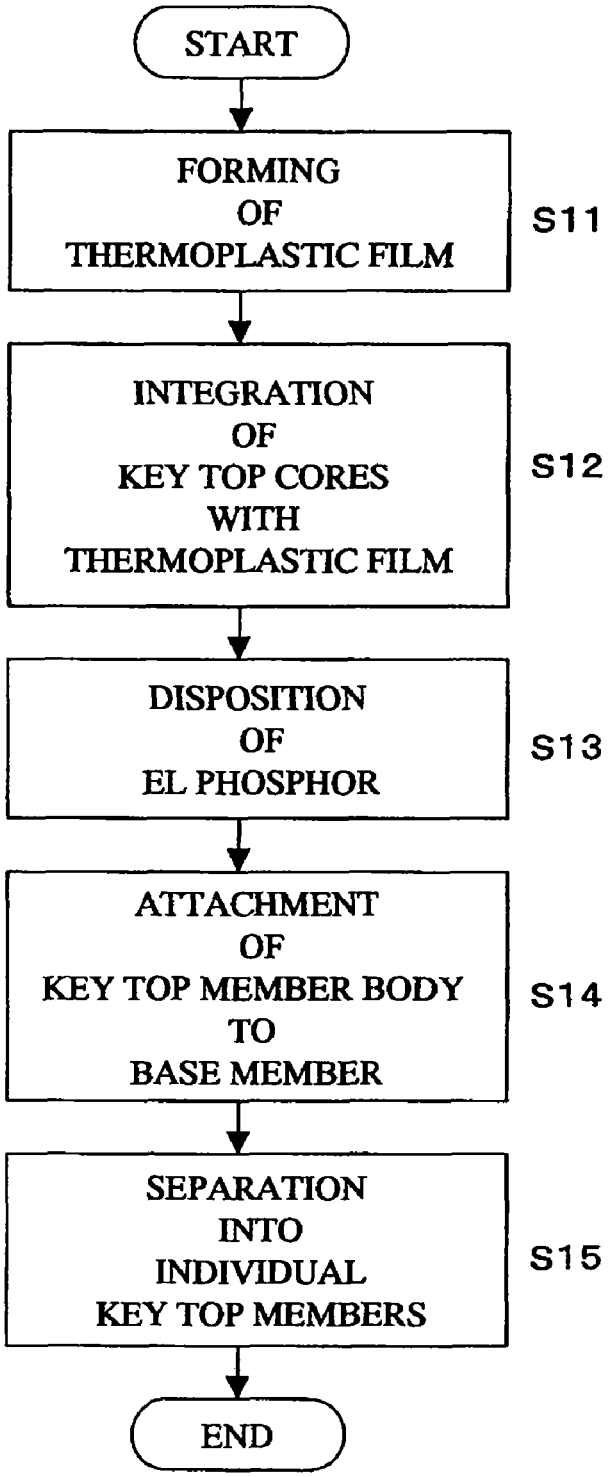
FIG. 12 is a flowchart showing the main steps of the manufacturing process of the member for push-button switch shown in FIGS. 11A to 11C.
Figure 13:
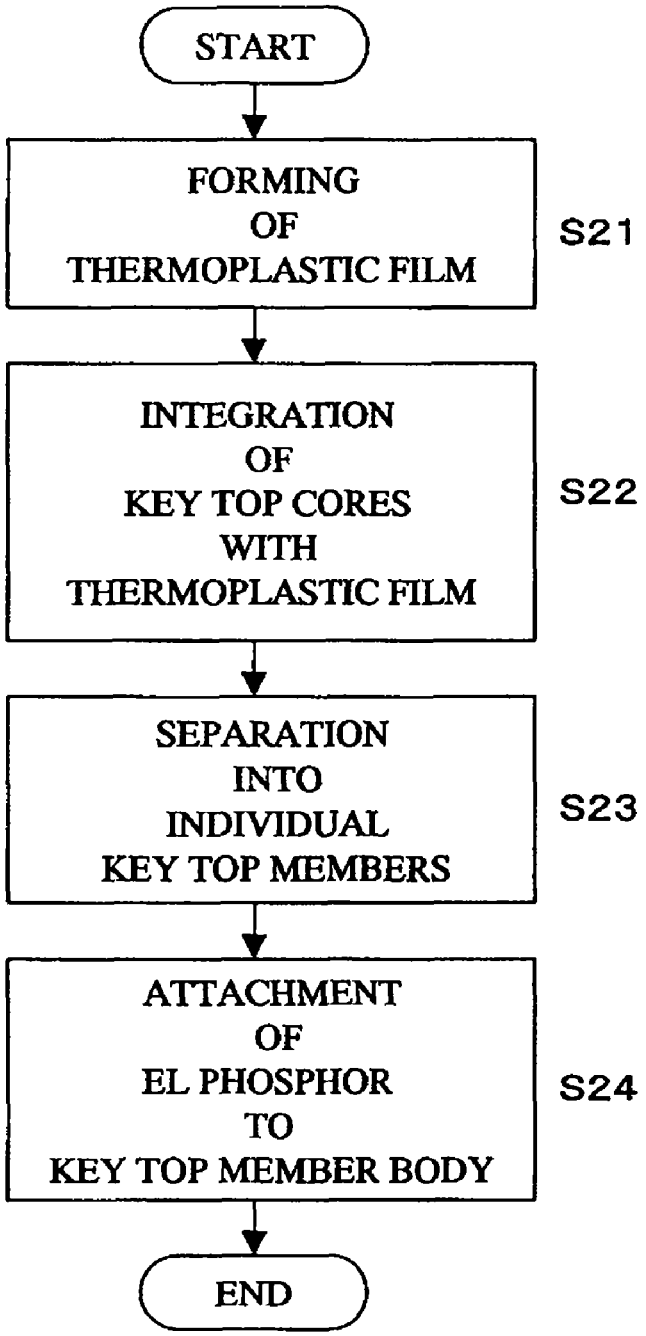
FIG. 13 is a flowchart showing the main steps of the manufacturing process of the member for push-button switch shown in FIGS. 11A to 11C.

FIGS. 12 and 13 are flowcharts showing the main steps of the manufacturing process of the second embodiment of the member for push-button switch 1 according to the present invention.

The steps S11, S12, S14, and S15 in FIG. 12 are the same steps as the steps S1, S2, S3, and S4 in FIG. 3, respectively. Therefore, repeated descriptions of these steps will not be described. The order of the steps S14 and S15 may be reversed, wherein the key top member body 23 is separated into individual units of the key top members 2, and then the key top members 2 are attached to the base member 3. Alternatively, the step S15 may be carried out before the step S13, and the step S14 may be carried out after the step S13.

The step S13 is not included in the first embodiment. In the step, the EL phosphor 70 is arranged between the key top members 2 and the base member 3. In case where the resin film 4 is not provided, the EL phosphor 70 is placed just below the key top members 2. Unlike LED 60, the EL phosphor 70 has a thin sheet-like shape, which allows to be placed just below the key top members 2.

As shown in FIG. 13, the member for push-button switch 1 may be manufactured through the steps of forming the thermoplastic film 22 (step S21), integrating the key top cores 21 with the thermoplastic film 22 (step S22), separating the key top members 2 into individual units (step S23), and attaching the separated units of the key top members 2 to the EL phosphor 70 (step S24). In the step S24, the attachment may be carried out with or without the intervention of the resin film 4.

The EL phosphor 70 may be an inorganic EL phosphor which includes an inorganic substance such as zinc sulfide evaporated onto a glass substrate, and emits light upon application of a voltage, or an organic EL phosphor which is having an organic substance such as a diamine evaporated onto a glass substrate, and emits light upon application of a voltage. More preferable examples of the EL phosphor 70 include an inorganic EL phosphor having an inorganic substance printed on a resin film (for example, PET, PEN, urethane, or PC/PBT alloy). Specific examples of the phosphor include: an inorganic EL phosphor made by evaporating a resin film onto a transparent conductive material such as indium tin oxide (ITO), and then printing an inorganic phosphor layer, a dielectric layer, a back conductive layer, and an insulating layer on the resin film in this order; an inorganic EL phosphor made by printing a conductive polymer or ITO ink onto a resin film, and then printing thereon an inorganic phosphor layer, a dielectric layer, a back conductive layer, and an insulating layer in this order; and an inorganic EL phosphor made by printing a back conductive layer, a dielectric layer, an inorganic phosphor layer, a conductive polymer, and a transparent insulating layer on a resin film in this order. An inorganic EL phosphor made by printing an inorganic substance onto a resin film, and then removing the resin film thereby leaving the printed material alone may be employed. Specific examples include an inorganic EL phosphor made by printing a transparent insulating layer onto a carrier film, printing thereon a conductive polymer, an inorganic phosphor layer, a dielectric layer, a back conductive layer, and an insulating layer in this order, and then removing the carrier film thereby leaving the printed material alone. The EL phosphor 70 may be an EL phosphor having a printed organic substance. The EL phosphor 70 provides high brightness at a low voltage, and is excellent in terms of the visibility, response speed, life, and power consumption. Accordingly, the EL phosphor 70 is suitable as a light-emitting member for the key top members 2 in the member for push-button switch 1.

In the above-described embodiments, all the key top members 2 have a tapered shape expanding toward the base member 3. The key top members 2 may have the same areas in the horizontal direction. In such a case, the distance d between the key top members 2 may be the distance between the tops of the key top members 2, or the distance between the bases of the adjacent flanges 22*a*.

In the above-described embodiments, the tops of the key top members 2 has the maximum thickness (t0) in the thermoplastic film 22, and the sides of the key top members 2 have the minimum thickness (t1). The portions having the maximum thickness (t0) and the minimum thickness (t1) may vary according to the shape of the key top members 2. In addition, each of the sheets of the thermoplastic film 22 covering the top and sides of the key top members 2 may not have a uniform thickness. In such a case, the maximum thickness (t0) resides in the portion on the top of the key top members 2 where the thermoplastic film 22 has the maximum thickness, and the minimum thickness (t1) resides in the portion on the sides where the thermoplastic film 22 has the minimum thickness. In case where the tops of the key top members 22 have local projections and depressions, the projections and depressions are not included in the criterion of the height of the key top members 2.

The thermoplastic film 22 is not limited to one shaped article integrally formed so as to conform to the final arrangement of all the push buttons of the member for push-button switch 1. The member for push-button switch 1 may include a plurality of the thermoplastic film 22 which cover the regions containing a plurality of the adjacent key top members 2.

In case where the key top cores 21 are made of a thermoplastic resin in place of the photocuring resin, examples of the thermoplastic resin include polyethylene, polypropylene, polyvinyl chloride, polystyrene, an acrylonitrile butadiene styrene copolymer resin, an acrylonitrile styrene copolymer resin, a methacrylic resin, polyvinyl alcohol, polyvinylidene chloride, polyethylene terephthalate, polyamide, polyacetal, polycarbonate, modified polyphenylene ether, polybutylene terephthalate, GF enhancement polyethylene terephthalate, ultra high molecular weight polyethylene, polysulfon, polyether sulfon, polyphenylene sulfide, polyarylate, polyamide imide, polyether imide, polyether ether ketone, polyimide, fluoro resins, liquid crystalline polymers, polyaminobismaleimide, polybisamide triazole, or the like.

EXAMPLE

Three kinds of acrylic resins each having a thickness of 100, 200, and 300 μm were used as the films for integrally forming the thermoplastic film 22. In addition, a plurality of the molds 40 were prepared thereby forming the thermoplastic film 22 for covering the key top members 2 having a tapered shape expanding from the top to the flanges 22*a*, wherein the value obtained by dividing the average of the heights of the key top members 2 (expressed by (h1+h2)/2, where h1 and h2 are heights of the key top members 2) by the distance (gap) d between the tops of the key top members 2 is in the range from 0.2 to 2.2. The forming method was pressure forming, and the air pressure was 5 kgf/cm$^2$. The mold 40 was heated at a temperature of 140° C., and the pressure forming was carried out with the assistance of the plug 41.

COMPARATIVE EXAMPLE

Three kinds of molds 40 were prepared thereby forming the thermoplastic film 22 for covering the key top members 2 having a tapered shape expanding from the top to the flanges 22*a*, wherein the value obtained by dividing the average of the heights of the key top members 2 (expressed by (h1+h2)/2) by the distance (gap) d between the tops of the key top members 2 is 0, 1, 2.4, and 2.6. Other conditions were the same as the above-described example.

TABLE 1

| | Thickness of thermoplastic film (μm) | | | |
|---|---|---|---|---|
| (h1 + h2)/2d | 100 | 200 | 300 | t1/t0 |
| 2.6 | Whitened | Ruptured | — | 0.30 |
| 2.4 | Whitened | Whitened | Ruptured | 0.35 |
| 2.2 | ○ | ○ | ○ | 0.40 |
| 2.0 | ○ | ○ | ○ | 0.45 |
| 1.8 | ○ | ○ | ○ | 0.50 |
| 1.6 | ○ | ○ | ○ | 0.55 |
| 1.4 | ○ | ○ | ○ | 0.60 |
| 1.2 | ○ | ○ | ○ | 0.65 |
| 1.0 | ○ | ○ | ○ | 0.70 |
| 0.8 | ○ | ○ | ○ | 0.75 |
| 0.6 | ○ | ○ | ○ | 0.80 |
| 0.4 | ○ | ○ | ○ | 0.85 |
| 0.2 | ○ | ○ | ○ | 0.90 |
| 0.1 | X | X | X | 0.95 |

Table 1 summarizes the conditions for manufacturing in the above-described example and comparative example, together with the characteristic evaluation of the thermoplastic film 22 made under the conditions. In Table 1, "circle" means the success in accurate forming according to the projections and depressions of the mold 40, and "cross" means the failure in accurate forming according to the projections and depressions of the mold 40. "Whitened" means the state of stress whitening of the thermoplastic film 22 because of excessive elongation, and "Ruptured" means the state of rupture of the thermoplastic film 22.

Table 1 shows when the key top members 2 were prepared so as to satisfy (h1+h2)/2d=0.1, all of the three kinds of the thermoplastic film 22 failed in accurate forming. The ratio t1/t0 was 0.95 at this time. When the key top members 2 were prepared so as to satisfy (h1+h2)/2d=2.6, the thermoplastic film 22 having a thickness of 100 μm was whitened by stress, and the thermoplastic film 22 having a thickness of 200 μm was ruptured. The ratio t1/t0 was 0.30 at this time. When the key top members 2 were prepared so as to satisfy (h1+h2)/2d=2.4, the thermoplastic film 22 having a thickness of 100 μm or 200 μm was whitened by stress, and the thermoplastic film 22 having a thickness of 300 μm was ruptured. The ratio t1/t0 was 0.35 at this time. On the other hand, when the key top members 2 were prepared so as to satisfy (h1+h2)/2d=0.2 to 2.2, all of the three kinds of the thermoplastic film 22 succeeded in accurate forming. The ratio t1/t0 was in the range from 0.4 to 0.9 at this time.

When the conditions in the example were changed so as to increase the air pressure during pressure forming to 7, 8, and 9 kgf/cm$^2$, the success or failure in forming the thermoplastic film 22 was the same as the results listed in Table 1. On the other hand, when the air pressure during pressure forming was decreased to 3 and 4 kgf/cm$^2$, the same results as those listed in Table 1 were obtained, but the accuracy of forming was rather lower than the case where the air pressure was 5 kg/cm$^2$ or more. From these facts, the pressure of the compressed air during forming is preferably 5 kgf/cm$^2$ or more.

When the conditions in the example were changed so as to carry out forming without using the plug 41. As a result, accurate forming was achieved, but it was found that the use of the plug 41 increases the accuracy in forming when the ratio t1/t0 is 0.7 or less (more specifically, (h1+h2)/2d is 1.0 or more).

INDUSTRIAL APPLICABILITY

The present invention is available as a member for push-button switch used in, for example, a mobile communication equipment, a digital camera, an electronic notebook, an in-car panel switches, a remote control units, and a keyboard.

The invention claimed is:

1. A member for a push-button switch, comprising a plurality of key top members each having a resin key top core and a thermoplastic film covering the key top core except for a bottom thereof, wherein among the key top members, at least two adjacent key top members are arranged from one another at a distance of 1.5 mm or less, the thermoplastic film covering tops of the key top cores in the adjacent key top members arranged at the distance of 1.5 mm or less has a maximum thickness (t0) in a range from 75 to 350 μm, and a ratio (t1/t0) of a minimum thickness (t1) of the thermoplastic film covering sides of the key top cores to said maximum thickness (t0) is in the range from 0.4 to 0.9.

2. The member for a push-button switch according to claim 1, wherein the key top cores are made of a photocuring resin.

3. The member for a push-button switch according to claim 1, wherein an electroluminescence (EL) phosphor is placed on the key top cores on the side not covered by the thermoplastic film.

* * * * *